US007396081B2

(12) United States Patent
Matern et al.

(10) Patent No.: US 7,396,081 B2
(45) Date of Patent: Jul. 8, 2008

(54) CHAIR HEIGHT ADJUSTMENT MECHANISM

(75) Inventors: Gerard J. Matern, Waterloo (CA); David Lloyd Hobb, Waterloo (CA); Kerry J. Brodrecht, Waterloo (CA)

(73) Assignee: Leggett & Platt Canada Co., Waterloo, Ontario (CA)

( * ) Notice: Subject to any disclaimer, the term of this patent is extended or adjusted under 35 U.S.C. 154(b) by 581 days.

(21) Appl. No.: 10/439,585

(22) Filed: May 16, 2003

(65) Prior Publication Data

US 2004/0227387 A1 Nov. 18, 2004

(51) Int. Cl.
*A47C 1/00* (2006.01)
*A47C 3/00* (2006.01)

(52) U.S. Cl. ..... 297/344.19; 297/344.16; 297/344.12; 297/300.3; 297/302.2; 297/301.2

(58) Field of Classification Search ..... 297/344.12, 297/344.16, 344.19, 344.18, 300.3, 302.2, 297/301.2; 248/404
See application file for complete search history.

(56) References Cited

U.S. PATENT DOCUMENTS 3,930,565 A * 1/1976 Scheben et al. ..... 188/300
4,373,692 A * 2/1983 Knoblauch et al. ..... 248/162.1
4,561,693 A * 12/1985 Brownlie et al. ..... 297/300.5
4,779,925 A * 10/1988 Heinzel ..... 297/300.4
4,787,673 A * 11/1988 Locher ..... 297/300.3
5,029,822 A * 7/1991 Selzer ..... 267/64.12
5,244,253 A * 9/1993 Hollington et al. ..... 297/344.19
5,257,851 A * 11/1993 Kanaya ..... 297/344.13
5,636,899 A * 6/1997 Schiff et al. ..... 297/411.36
6,045,187 A 4/2000 Stumpf ..... 297/344.19
6,213,552 B1 * 4/2001 Miotto ..... 297/300.5
6,224,155 B1 * 5/2001 DeKraker et al. ..... 297/344.12
6,290,296 B1 9/2001 Beggs ..... 297/344.16
6,361,110 B2 * 3/2002 Roslund et al. ..... 297/344.19
6,692,077 B1 * 2/2004 Beggs et al. ..... 297/344.19
2002/0140277 A1 * 10/2002 Pan ..... 297/463.1
2005/0173933 A1 * 8/2005 Cetnar et al. ..... 292/216

FOREIGN PATENT DOCUMENTS

DE 3415619 A * 12/1984
JP 06014822 A * 1/1994
WO WO 9500051 A1 * 1/1995

* cited by examiner

*Primary Examiner*—Sarah B McPartlin
(74) *Attorney, Agent, or Firm*—Shook, Hardy & Bacon LLP

(57) ABSTRACT

A chair control mechanism has a rotatable shaft with a radially extending member abutting an actuating finger of a gas control cylinder. A slider may push a second radially extending member of the rotatable shaft in order to rotate the shaft. The slider has a tab extending into the mouth of the head of a further shaft which is rotated by a user operated handle. Thus, when the user operates the handle, the head of the further shaft causes the slider to slide.

16 Claims, 2 Drawing Sheets

CHAIR HEIGHT ADJUSTMENT MECHANISM

FIELD OF THE INVENTION

The present invention relates to a chair control mechanism, and more particularly to a height adjustment mechanism for a chair.

BACKGROUND

Height adjustment mechanisms for controlling the height of a chair are well known. Typically, such mechanisms actuate a gas cylinder on which a chair is supported. Conventional gas cylinders have two chambers separated by a normally closed valve. Protruding from one end of the gas cylinder is a valve-opening button, or finger, that when depressed causes the valve separating the two gas cylinder chambers to open, thereby allowing the cylinder to extend or retract in order to adjust the height of the chair.

Known actuation mechanisms for actuating the valve-opening member typically consist of a rod that is tiltably mounted above the valve-opening finger. The rod typically terminates in a handle which is accessible by the user. With this type of actuation mechanism, the user may raise the handle, thereby causing the rod to tilt downward and depress the valve-opening finger. An example of such an actuation mechanism is described in U.S. Pat. No. 6,290,296 to Beggs.

A common problem that exists with the above-described actuation mechanisms is that they have relatively large space requirements to accommodate the rod inside the housing assembly, and to allow the rod to be tilted. This requires the housing assembly in which the rod resides to be relatively large. Large and bulky housing assemblies detract from the aesthetic appearance of chairs.

One proposed solution to the aforesaid problems is described by U.S. Pat. No. 6,213,552 to Miotto. There, the height adjustment mechanism consists of a slider element motivated by a user actuatable handle. The slider may be pushed inwardly against an upstanding arm of a pivoting member. This causes the pivoting member to pivot so that a second arm of the pivoting member depresses the valve control finger. A drawback of the mechanism described in Miotto is that it is relatively complex.

It would therefore be desirable to have a height adjustment mechanism for a chair that is simple in design, does not unduly detract from the aesthetic appeal of the chair, and whose physical dimensions are relatively small.

SUMMARY OF INVENTION

It is therefore the object of the present invention to provide for a relatively compact and simple height adjustment mechanism for a chair.

To achieve these and other objects of the present invention, there is provided a control for a gas cylinder of a chair, comprising: a rotatable member with a radial projection, said member rotatably mounted such that said projection extends over an opening for receiving a gas control finger, said rotatable member oriented such that when said member rotates said projection may move toward said opening; and means for rotating said rotatable member.

According to a further aspect of the present invention, there is provided a chair control mechanism comprising: a) a rotatable shaft with a radially extending member overlying an opening for receiving a gas control cylinder actuator; b) an actuator for rotating said shaft.

BRIEF DESCRIPTION OF THE DRAWINGS

In drawings illustrating by way of example only, embodiments of the invention.

DETAILED DESCRIPTION

Figure 1:
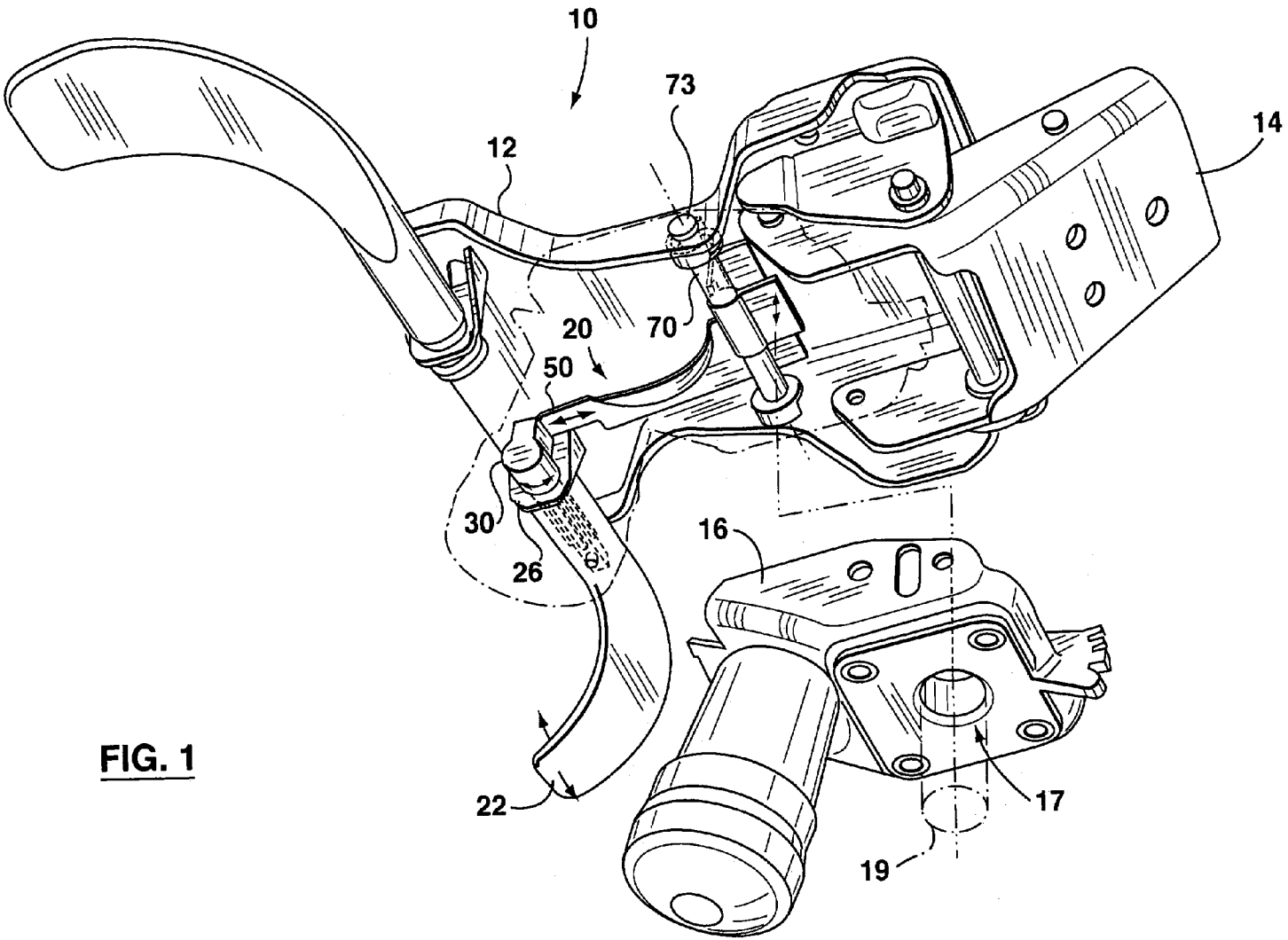
FIG. 1 is a bottom perspective, partially exploded view of a chair control mechanism having a height adjustment mechanism made in accordance with the present invention.

FIG. 1 shows a perspective view of the of a height adjustment mechanism 20 forming part of a chair control 10 for a chair. Chair control 10 has a seat bracket 12 that may be fastened to the seat of the chair (not shown), back bracket 14 for mounting to the chair's backrest (not shown), and a main frame 16 with an opening 17. The main frame 16 is supported on a gas control cylinder (not shown) of a chair such that the gas control finger 90 of the cylinder extends through opening 17. Seat bracket 12 accommodates height adjustment mechanism 20. As will become apparent, height adjustment mechanism 20 comprises a rotatable shaft 30 that is rotated by handle 22, a slider member 50 that is slid by rotatable shaft 30, and a rotatable shaft 70 that is rotated by slider member 50. The rotatable shaft 70 can depress valve control finger 90 of a gas cylinder (not shown) on which the chair control mechanism is supported.

Figure 2:
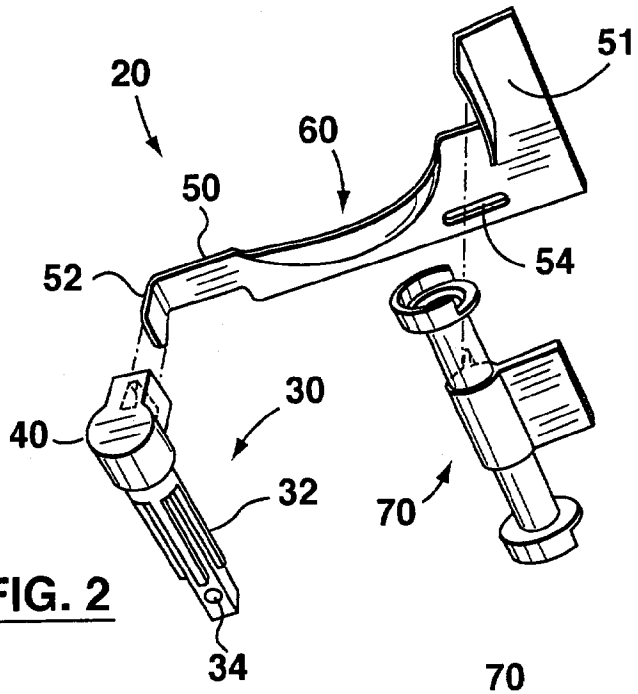
FIG. 2 is an exploded view of height adjustment mechanism of FIG. 1.
Figure 3:
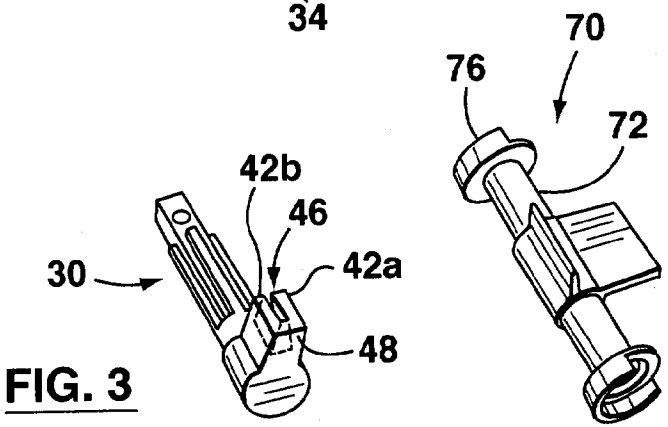
FIG. 3 is a top perspective view of a portion of the height adjustment mechanism shown in FIG. 2.

FIGS. 2 and 3 more clearly illustrate the height adjustment mechanism 20 of the present invention. As can be seen from FIG. 2, shaft member 30 has a rectangular ribbed body 32 and an enlarged head 40. Located proximate to one end of the body 32 is an aperture 34. Referencing FIG. 1, rotatable shaft 30 is received through a short sleeve (not shown) fixed to a flange 26 depending from seat bracket 12. The sleeve of flange 26 has a diameter that is slightly larger than the diameter of body 32 of shaft 30, but smaller than the diameter of head 40 of the shaft 30, so that rotatable shaft 30 may be inserted through the sleeve until head 40 abuts the sleeve. A handle 22, shown in FIG. 1, may have a central bore with a complementary shape to that of body 32 of shaft 30. In consequence, the central bore of the handle may receive the ribbed body 32 of the shaft so that an aperture (not shown) in the handle is aligned with the aperture 34 in the body 32 of shaft member 30. Thereafter, a pin or other fastening member (not shown) may be inserted through both the aperture in the handle and the aperture 34 in body 32 to lock the handle 22 to shaft 30. With this arrangement, shaft 30 will rotate with handle 22 and the sleeve of flange 26 will be sandwiched between head 40 of shaft 30 and the inner end of handle 22. Bracket 26 thus holds rotatable shaft 30 in place.

Figure 4:
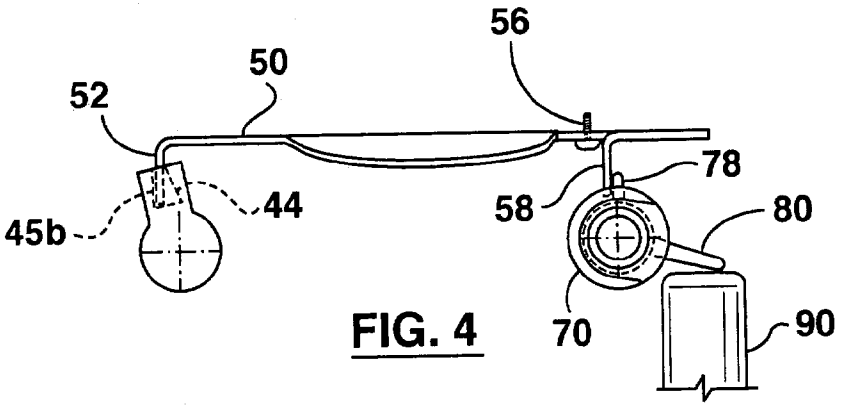
FIG. 4 is a side view of the height adjustment mechanism of FIG. 1 in a first position.

With reference to FIGS. 2 to 4, extending radially from head 40 are lips 42. Lips 42 define a channel 44 therebetween, which, in side view (FIG. 4), has a generally truncated triangular shape. Triangular channel 44 terminates in mouth 46. The lips are joined at the outer end 48 of the head 40, but not at the inner end where the head joins the ribbed body 32.

As may be appreciated by the person skilled in the art, rotatable shaft 30 may be integrally formed as a single piece from a material, such as plastic. Such an integrally formed structure may be manufactured using for example, known injection molding or extrusion methods. Further, as may also be appreciated by the person skilled in the art, shaft 30 may have many other configurations. For example, body 32 need not be ribbed. Similarly, any means for ensuring that rotatable shaft remains firmly in place inside the central bore of handle 22 can be used instead of using a pin inserted into an aperture at the end of the shaft.

As can be seen from FIGS. 1 and 2, the main body 51 of slider member 50 may be positioned above and perpendicular to rotatable shaft 30 with a tab 52 extending downwardly from one end of the slider member 50 through mouth 46 (FIG. 3) of shaft 30 into cavity 44 (FIG. 4). With reference to FIGS. 2 and 4, an elongate slot 54 in slider member 50 receives a peg 56 (in the nature of a screw) that is supported by (screwed into) the seat bracket 12 (FIG. 1). This constrains the slider to slide in a horizontal direction along the seat bracket. Furthermore, the slot and peg arrangement sets the endpoints for the sliding of the slider member 50 and hence the limits of rotation of shaft 30 and shaft 70. Where the seat bracket 12 has projections into the path of the slider member 50, the slider may be fashioned to have features and contours that ensure that the seat bracket 12 does not hinder the movement of the slider member 50. For this reason, for illustrative purposes, FIG. 2 shows that the body 51 of the slider member 50 is not entirely flat, but rather has a concavity 60 that may accommodate a downward projection of the seat bracket 12 positioned directly above slider member 50. Thus, the concave portion allows slider member 50 to move horizontally without hitting the downward projection of the seat bracket 12. A tab 58 extends downwardly from the other end of the L-shaped slider member 50.

As will be appreciated by the person skilled in the art, slider member 50 may be integrally formed as a single piece of deformable material, for example metal, such that the slider member 50 can be manufactured as a generally flat piece, and can thereafter be folded and shaped to form tabs 52 and 58, and concavity 60.

As can be seen from FIGS. 2 and 3, rotatable shaft 70 has of a tubular cylindrical body 72. Tubular body 72 may be supported by a rod 73 (FIG. 1) that is anchored in the walls of the seat bracket 12 of the chair control mechanism.

Tabs 78 and 80 extend radially from shaft 70 with tab 78 extending upwardly in front of tab 58 of slider 50 so that upon the horizontal displacement of slider member 50, tab 58 of the slider can push tab 78 of shaft 70. Tab 80, on the other hand, extends generally horizontally above the valve-opening finger of the gas cylinder that controls the height of the chair. In consequence, when tab 58 of the slider pushes tab 78 of the rotatable shaft 70, shaft 70 rotates clockwise and tab 80 presses down on the valve-opening finger of the gas cylinder.

Like rotatable shaft 30, rotatable shaft 70 may also be integrally formed as a single piece of material such as plastic, and may therefore, for example, be manufactured using known injection molding or extrusion methods.

FIG. 4 shows the height adjustment mechanism 20 in its resting position. As can be seen from FIG. 4, tab 52 of slider member 50 extends inside triangular channel 44 of rotatable shaft 30 and abuts wall 45*b* of channel 44. Tab 58 of slider 50, on the other hand, abuts radial tab 78 of rotatable shaft 70. Radial tab 80 of shaft 70 abuts, but does not operatively depress valve-opening finger 90 of the gas cylinder used to control the height of the chair.

Figure 4A:
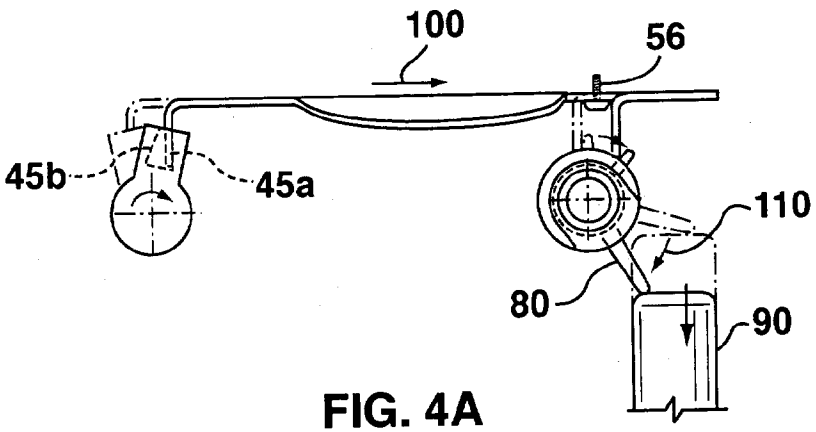
FIG. 4A is a side view of the height adjustment mechanism of FIG. 1 in a second position.

As can be seen in FIG. 4A, in operation, upon turning the user-controlled handle 22 (FIG. 1), rotatable shaft 30 rotates clockwise. In consequence, the rear lip 42*b* of mouth 46 (through which tab 52 enters the channel 44) presses against tab 52, thereby laterally pushing tab 52, and causing slider member 50 to move horizontally in the direction of arrow 100. As shaft 30 rotates, the tab 52 of slider 50 moves away from wall 45*b* and into abutment against wall 45*a* of channel 44. Thus, the triangular shape of cavity 44 avoids bending of tab 52 when shaft 30 rotates, thereby reducing fatigue of tab 52 consequent upon repeated operational cycles.

As a result of the horizontal sliding of slider member 50, tab 58 pushes tab 78 of rotatable shaft 70, thereby causing rotatable shaft 70 to rotate clockwise in the direction of arrow 110. This in turn causes tab 80 to press against valve-opening finger 90, pushing finger 90 downwards, and thereby allowing the height of the chair to be adjusted.

Since valve-opening finger is biased to its extended, valve closing, position, when the user releases handle 22, finger 90 returns to its extended position, thereby pushing tab 80 upwards, and causing rotatable shaft 70 to rotate counterclockwise about its longitudinal axis. This in turn causes tab 78 to push against tab 58 of slider member 50. As a result slider member 50 moves horizontally in the direction opposite that indicated by arrow 100. Consequently, tab 52 presses against lip 42*b* of mouth 46, thereby causing rotatable shaft 30 to rotate counterclockwise and return the shaft 30 to its initial resting position.

Obviously, arrangements other than slot 54 and peg 56 may be used to limit rotation of shafts 30 and 70. For example, the slot in the slotted rims 76 (FIG. 3) of shaft 70 may receive an abutment to limit rotation of shaft 70 and, consequently, shaft 30.

The foregoing describe only some embodiments, and other modifications and variations will readily become apparent to those of ordinary skill in the art without departing from the scope of the invention as defined by the claims hereinafter.

What is claimed is:

1. A control for a gas cylinder of a chair, comprising:

a) first rotatable member with a first radial projection and a second radial projection, said first member rotatably mounted such that said first projection extends over an opening for receiving a gas control finger, said first rotatable member oriented such that when said first member rotates said first projection may move toward said opening; and b) means for rotating said first rotatable member comprising a slider member mounted for non-rotational linear sliding movement such that said slider may be slid so as to push said second projection and actuating means for sliding said slider member, said actuating means comprising a second rotatable member, wherein said second rotatable member has a radially directed channel such that said channel rotates with rotation of said second rotatable member, and wherein said sliding member further comprises a tab received by said channel.

2. The control of claim 1 wherein second projection is circumferentially spaced from first projection.

3. The control of claim 1 wherein said first radial projection and said second radial projection are tabs.

4. A chair control mechanism comprising:

a) a first rotatable shaft with a first radially extending member overlying an opening for receiving a gas control cylinder actuator and a second radially extending member;

b) an actuator for rotating said first rotatable shaft, said actuator comprising a slider mounted for non-rotational linear sliding movement, said slider for pushing against said second radially extending member and a second rotatable shaft with a radially directed channel formed therein and wherein said slider comprises a tab received by said channel.

5. The mechanism of claim 4 further comprising a main frame defining said opening and wherein said first shaft and said second shaft are rotatably mounted to said main frame.

6. The mechanism of claim 5 wherein said second shaft terminates in an operator controlled handle.

7. The mechanism of claim 6 wherein said second radially extending member is circumferentially spaced on said first shaft from said first radially extending member.

8. The mechanism of claim 4 wherein said radially directed channel tapers from a larger radially inwardly positioned base to a smaller radially outermost neck.

9. A control for a gas cylinder of a chair, comprising:

a) a first rotatable member with a first radial projection and a second radial projection, said member rotatably mounted such that said first projection extends over an opening for receiving a gas control finger, said rotatable member oriented such that when said member rotates in a first direction, said first projection moves toward said opening;

b) a slider member which is free of any connection to said second radial projection and which is mounted for non-rotational linear sliding movement such that said slider member may be slid so as to push said second projection in order to rotate said member in said first direction; and c) a second rotatable member for actuating said slider member, said second rotatable member having a radially directed channel such that said channel rotates with rotation of said second rotatable member, and wherein said sliding member further comprises a tab received by said channel.

10. The control of claim 9 wherein second projection is circumferentially spaced from first projection.

11. The control of claim 10 wherein said first radial projection and said second radial projection are tabs.

12. A chair control mechanism comprising:

a) a first rotatable shaft with a first radially extending member overlying an opening for receiving a gas control cylinder actuator and a second radially extending member;

b) an actuator for rotating said first rotatable shaft, said actuator comprising a slider for acting against said second radially extending member and a second rotatable shaft with a radially directed channel and wherein said slider comprises a tab received by said channel, said radially directed channel tapering from a larger radially inwardly positioned base to a smaller radially outermost neck.

13. The mechanism of claim 12 wherein said second shaft terminates in an operator controlled handle.

14. The mechanism of claim 13 wherein said second radially extending member is circumferentially spaced on said first shaft from said first radially extending member.

15. The mechanism of claim 14 further comprising a main frame defining said opening and wherein said first shaft and said second shaft are rotatably mounted to said main frame.

16. The mechanism of claim 15 wherein said first radially extending member and said second radially extending member are tabs.

* * * * *